US007331490B2

(12) United States Patent
Yamana

(10) Patent No.: US 7,331,490 B2
(45) Date of Patent: Feb. 19, 2008

(54) CONTAINER WITH AIR INTAKE MECHANISM

(75) Inventor: Shigeru Yamana, Imizu-gun (JP)

(73) Assignee: Aicello Chemical Co., Ltd., Toyama (JP)

( * ) Notice: Subject to any disclaimer, the term of this patent is extended or adjusted under 35 U.S.C. 154(b) by 52 days.

(21) Appl. No.: 10/506,068

(22) PCT Filed: Feb. 28, 2003

(86) PCT No.: PCT/JP03/02386

§ 371 (c)(1),
(2), (4) Date: Aug. 31, 2004

(87) PCT Pub. No.: WO03/074372

PCT Pub. Date: Sep. 12, 2003

(65) Prior Publication Data

US 2005/0092780 A1 May 5, 2005

(30) Foreign Application Priority Data

Mar. 5, 2002 (JP) ..... 2002-058129
Jul. 15, 2002 (JP) ..... 2002-205866

(51) Int. Cl.
*B67D 3/00* (2006.01)

(52) U.S. Cl. ..... 222/478; 222/479; 222/484; 215/902

(58) Field of Classification Search ..... 222/478–479, 222/481.5, 482, 484, 465.1, 468, 564, 442, 222/454; 215/902
See application file for complete search history.

(56) References Cited

U.S. PATENT DOCUMENTS

| | | | | |
|---|---|---|---|---|
| 3,308,997 | A * | 3/1967 | Kelly | 222/475 |
| 4,105,148 | A | 8/1978 | Williams | |
| 4,412,633 | A * | 11/1983 | Guerrazzi et al. | 222/468 |
| 4,804,119 | A | 2/1989 | Goodall | 222/468 |
| 4,856,685 | A * | 8/1989 | Gaffney | 222/454 |
| 5,123,575 | A * | 6/1992 | Li | 222/564 |
| 5,340,000 | A | 8/1994 | Ring | 222/468 |
| 5,897,035 | A * | 4/1999 | Schlomer | 222/479 |
| 6,029,858 | A * | 2/2000 | Srokose et al. | 222/143 |
| 6,494,350 | B2 * | 12/2002 | Kelley | 222/456 |
| 2003/0034363 | A1 | 2/2003 | Morgenroth | |

FOREIGN PATENT DOCUMENTS

| | | |
|---|---|---|
| DE | 201 12 279 | 10/2001 |
| EP | 0 058 624 | 8/1982 |
| JP | 10-230980 | 9/1998 |
| JP | 2000-334814 | 12/2000 |

* cited by examiner

*Primary Examiner*—Frederick C. Nicolas
(74) *Attorney, Agent, or Firm*—Steptoe & Johnson LLP

(57) ABSTRACT

An one-mouth container for storing liquid capable of preventing pulsating flow and controlling a discharging speed approximately at a constant independently of the amount of an internal liquid in the container when the internal liquid is discharged, in which a blow-molded portion (23) is formed on the container body side portion of a container mouth portion; a narrowed portion (24), a discharge port (31) and an air channel (11) extending from a side wall of the blow-molded portion (23) to a space at an upper part of the container body are formed by narrowing down the narrowed portion; the air channel has such a length that air supplied through the air channel (11) is released directly in the internal liquid; and both a discharge port (31) and an air port (25) are formed at the narrowed portion (24).

4 Claims, 15 Drawing Sheets

A - A

CONTAINER WITH AIR INTAKE MECHANISM

TECHNICAL FIELD

The present invention relates to a container for storing liquid, and more particularly to a container for storing liquid having a function, when an internal liquid remained in the container is discharged, capable of keeping liquid discharging speed approximately constant independently of the amount of the internal liquid and preventing pulsating flow from occurring.

BACKGROUND ART

As a conventional container of this kind, for example, there have been a two-mouth container as illustrated in FIG. 22 or a container having an air intake mechanism as illustrated in FIG. 23 (U.S. Pat. No. 5,340,000).

The two-mouth container illustrated in FIG. 22 has such a drawback that both the two mouths have to be opened to make an internal liquid discharge smooth without pulsation when the liquid in the container is discharged. Another drawback is that the two-mouth type container has itself a problem involving rise in production cost because of its shape and a need to provide two caps for each container. On the contrary, the container as illustrated in FIG. 23 has one mouth and is easy to handle. But such one-mouth container has a large air-supplying tube which is also used as a handgrip, so that degree of freedom of design is somewhat limited.

Further, these conventional containers have common characteristics that air to be supplied into the container is introduced directly into an internal space of the container without passing through the internal liquid. This type of air intake mechanism can realize very smooth discharge of the liquid since there is no resistance caused by the internal liquid when the internal liquid is replaced by air. However, the discharging speed varies with the height of the surface of the internal liquid. That is, the liquid is discharged at a higher speed at an initial stage of the discharge, when the large amount of the internal liquid is remained in the container. The discharging speed gradually decreases with decrease of the amount of the internal liquid.

Accordingly, there has been a need to control the discharging speed at a constant by adjusting an angle of inclination of the container in concert with the decrease of the internal liquid.

Figure 1A:
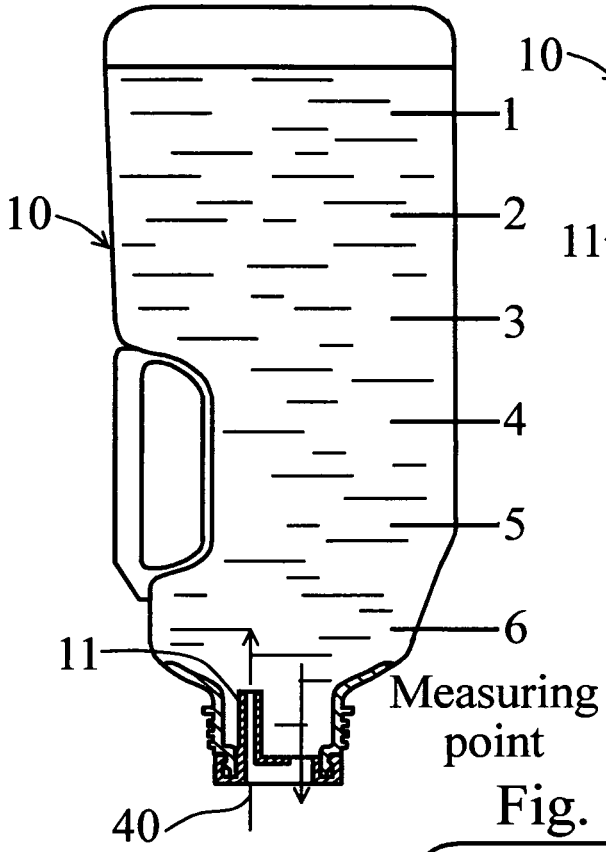
FIG. 1 is a view illustrating a state of a discharging test.

In these Figures, reference numerals are as follows: 10 is a bottle, 11 is an air channel, 21 is a container mouth portion, 22 is a container body, 23 is a blow-molded portion, 24 is a narrowed portion,

25÷ is an air port,

31÷ is discharge port, 45 is liquid, and 40 is air.

DISCLOSURE OF THE INVENTION

The above mentioned problems can be solved by a first aspect of the present invention, which is a container with an air intake mechanism comprising: a blow-molded portion 23, whose opening is larger than that of a container mouth portion 21, is formed by using a blow molding at a position under the container mouth portion 21; a narrowed portion 24 and a discharge port 31 in the narrowed portion 24 are formed by narrowing down on a container body 22 side portion of the blow-molded portion 23; and an air channel 11 extending from and connecting a side wall of the blow-molded portion 23 positioned over the narrowed portion 24 to an inner upper space of the container body 22, the air channel 11 has such a short length that air 40 supplied through the air channel 11 is released directly in an internal liquid 35 in the container when the internal liquid 35 is discharged.

A second aspect of the present invention of the container is characterized by that the narrowed portion 24, the discharge port 31 and an air port 25 are simultaneously formed by narrowing down a side portion of the container body 22 at the blow-molded portion 23.

Furthermore in order to improve the usability of the container, the discharge port 31 has an approximately the same axis along it of the mouth portion 21 and has approximately the same size and shape to the mouth portion 21.

Before performing Embodiments below, previous tests were carried out using bottles 10 shown in FIG. 1 to determine a relation between the amount of an internal liquid 35, that is water, remained in a container and a discharging speed in relation to the length of the air channel 11. Air 40 is supplied into a bottle 10 through an air channel 11 as indicating arrow line when the liquid 35 is discharged from the bottle 10 through a bottle mouth.

Figure 1B:
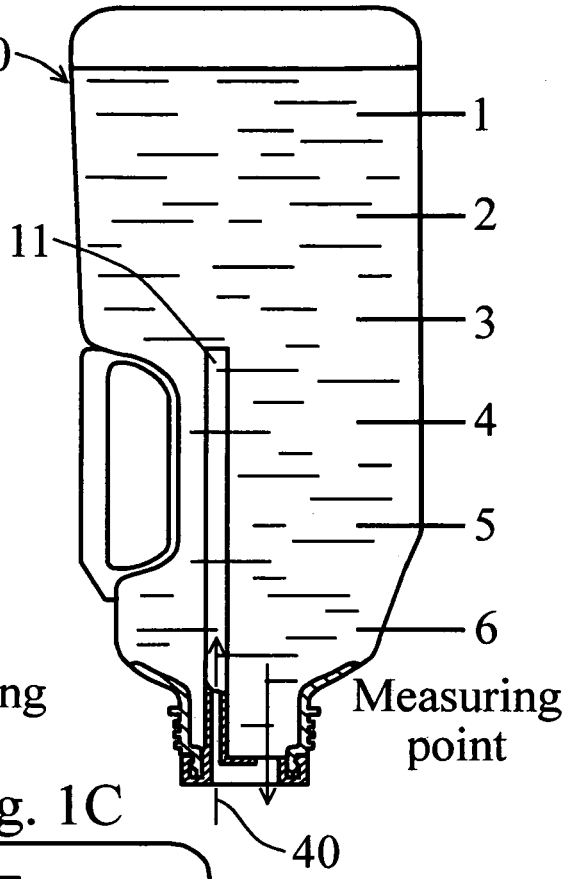
Figure 1C:
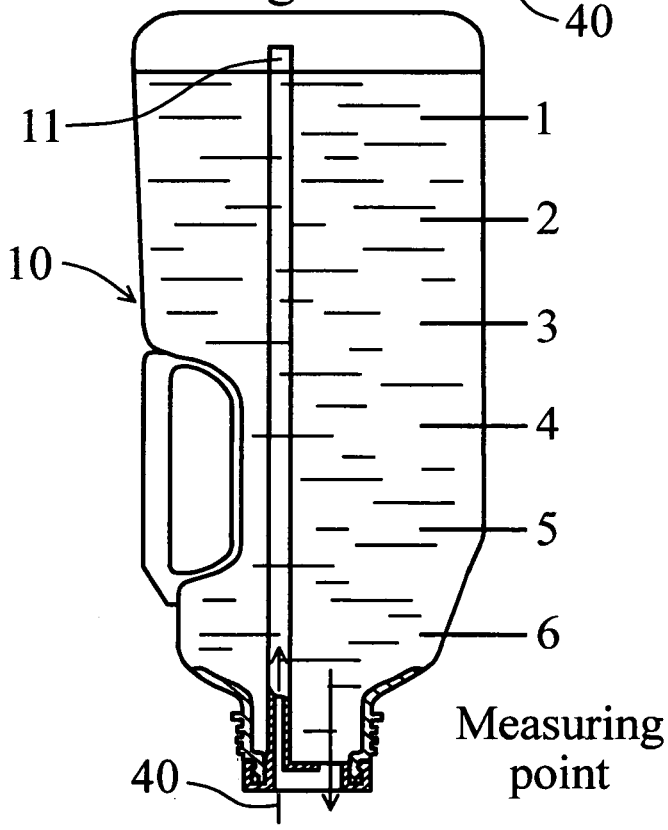

As shown in FIGS. 1A, 1B and 1C, three type bottles 10 having different lengths of air channels 11 were prepared for tests. The length of the air channel 11 in FIG. 1A is set at 20~30 mm which is the minimum length of necessity for ensuring pulsation-free flow when the internal liquid 35 is discharged; whereas in FIG. 1B, the length of the air channel is about a half of the height of the bottle 10; and in FIG. 1C, the length of the air channel 11 is approximately equal to the height of the bottle 10.

Each bottle 10 was nearly fully filled up with liquid 35 and then the bottle 10 was placed upside down shown in FIG. 1A, 1B or 1C to start discharging liquid 35. The surface of liquid 35 was lowering with progress of discharge of the internal liquid 35. Discharging speeds in FIG. 1 were measured at each height of the liquid surface indicated by 1 to 6 of measuring points. Discharging speeds were measured in terms of time period during which about 200ml of liquid was discharged from the bottle 10. The test results are shown in the next Table. Each A, B, C in the Table indicates a length of air channel 11 illustrated in FIG. 1A, FIG. 1B and FIG. 1C respectively.

TABLE

| Measuring | Discharging Time (Seconds/200 ml) | | |
|---|---|---|---|
| Point | A | B | C |
| 1 | 10.9 | 6.5 | 5.0 |
| 2 | 10.9 | 6.7 | 5.5 |
| 3 | 10.8 | 6.6 | 6.1 |
| 4 | 10.7 | 7.2 | 6.9 |
| 5 | 10.8 | 8.5 | 8.5 |
| 6 | 10.9 | 11.0 | 10.7 |

Figure 24:
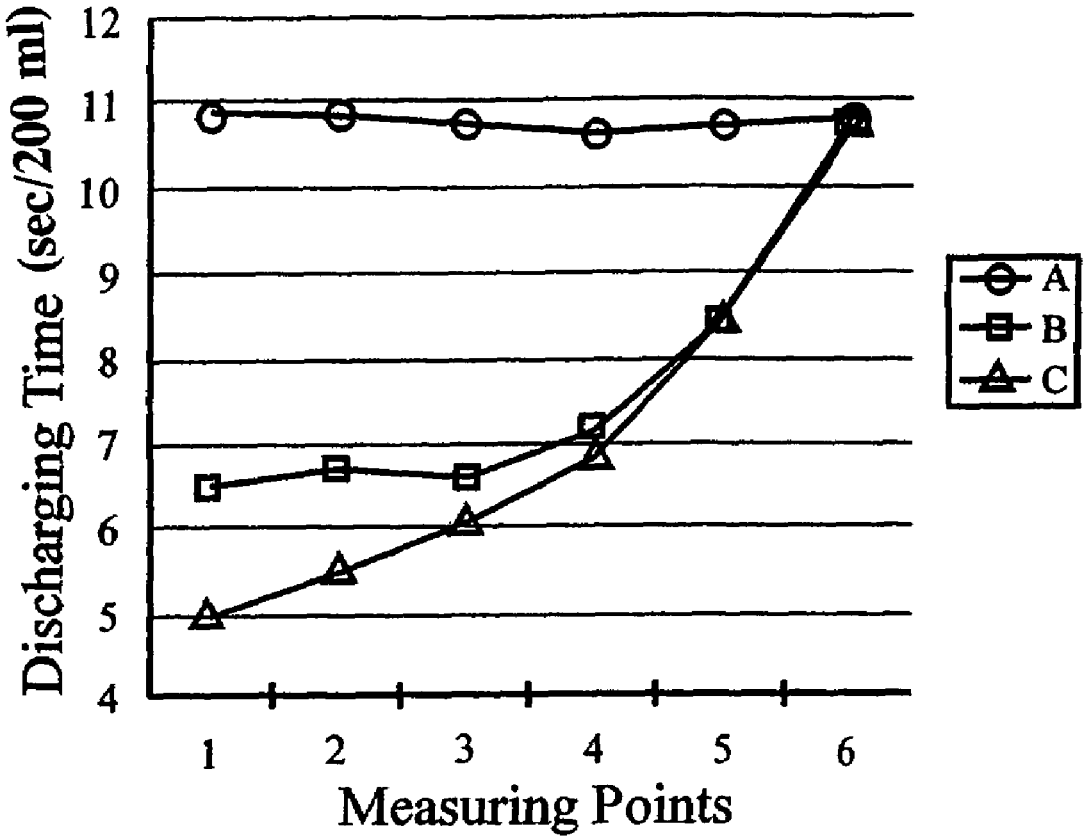
FIG. 24 is a graph showing relations of Measuring Points and Discharging time of liquid.

The result of the Table is shown in the graph of FIG. 24. The abscissa of the graph indicates measuring points and the ordinate thereof indicates discharging time by 200 ml. Curve line A is a discharging time using an air channel 11 illustrated in FIG. 1A, curve line B is a discharging time using an air channel 11 illustrated in FIG. 1B, and curve line C is a discharging time using an air channel 11 illustrated in FIG. 1C.

From the results, it is recognized that when the front edge of the air channel 11 is under the surface of the liquid, a specific discharging speed can be maintained that is specifically determined by the length of the air channel 11. Whereas when the front edge of the air channel 11 emerges from under the surface of the liquid 35, the discharging speed changes in proportion to the height of the surface of the liquid 35.

The bottle 10 of FIG. 1A, of which the length of the air channel 11 is the shortest, the front edge of the air channel is always under the surface of the liquid 35, discharging speed is saved and controlled, showing an approximately constant discharging speed independently of the height of the liquid surface. The liquid 35 was discharged extremely smooth as long as the front edge of the air channel was placed above the liquid surface. Although slight pulsation was observed when the front edge of the air channel was under the surface of the liquid 35, such slight pulsation causes no problem in practical use.

EMBODIMENTS OF THE INVENTION

Preferable embodiments will be explained below. However, the scope of the present invention is not limited to these embodiments.

First Embodiment

Figure 2A:
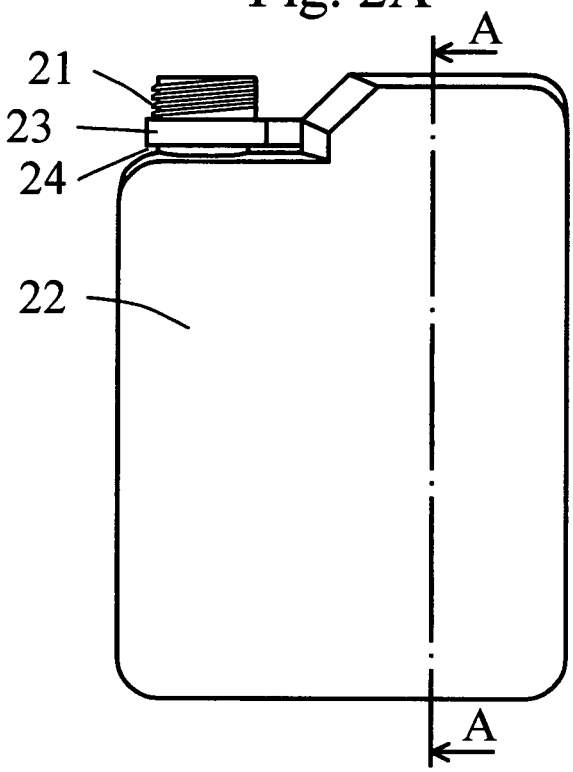
FIG. 2 includes a front view, a plane view and a sectional view taken along a line A-A, of a container according to a first embodiment.
Figure 2B:
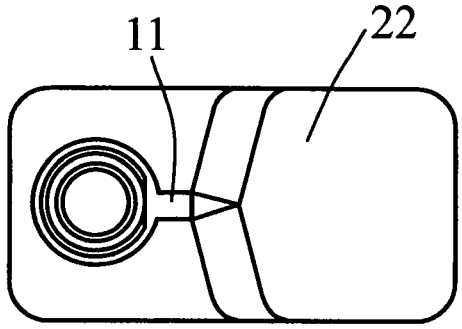
Figure 2C:
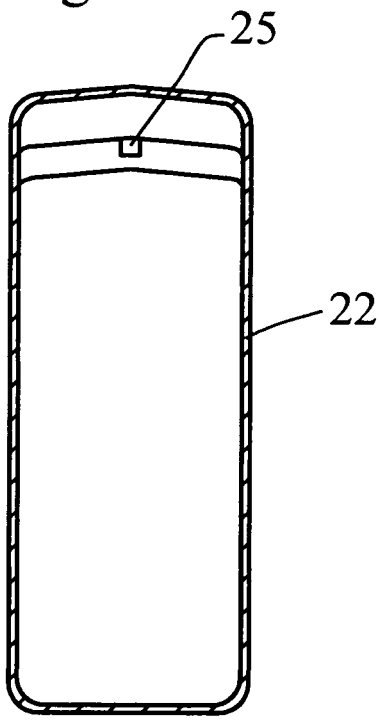
Figure 3:
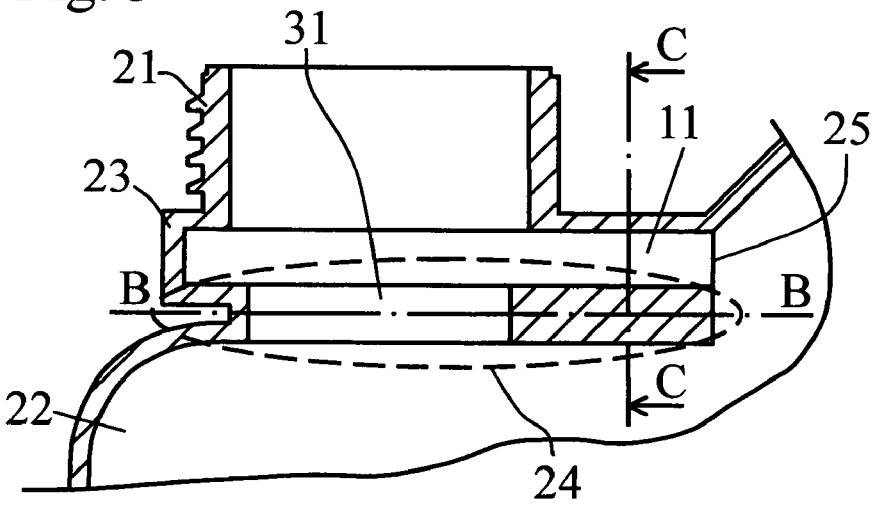
FIG. 3 is an enlarged sectional view of a mouth portion according to the first embodiment.
Figure 4:
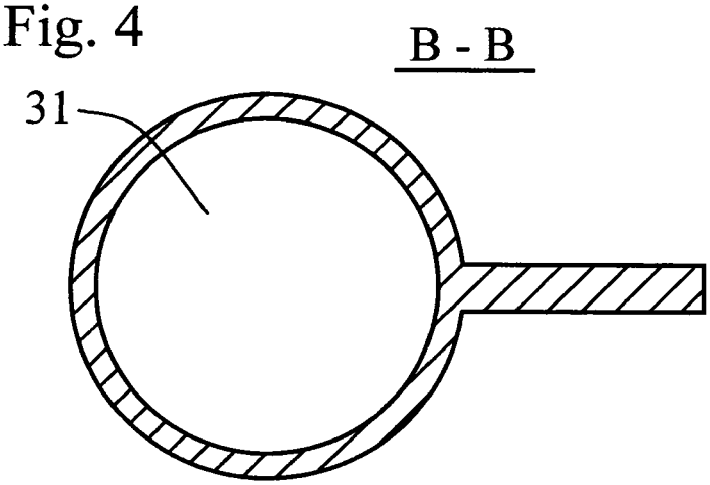
FIG. 4 is a sectional view taken along a line B-B in FIG. 3.
Figure 5:
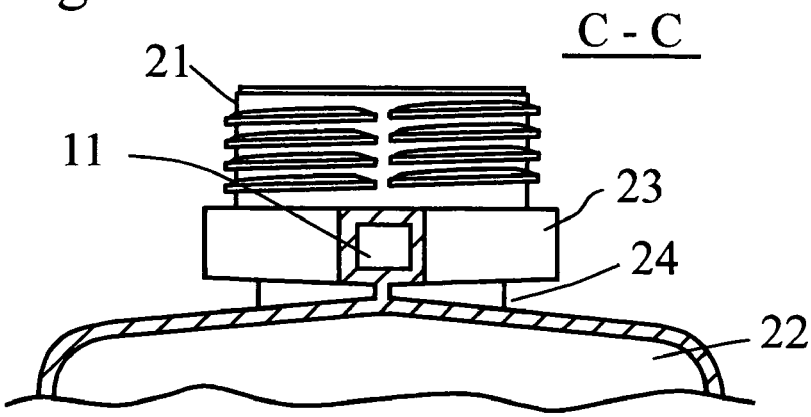
FIG. 5 is a sectional view taken along a line C-C in FIG. 3.
Figure 6:
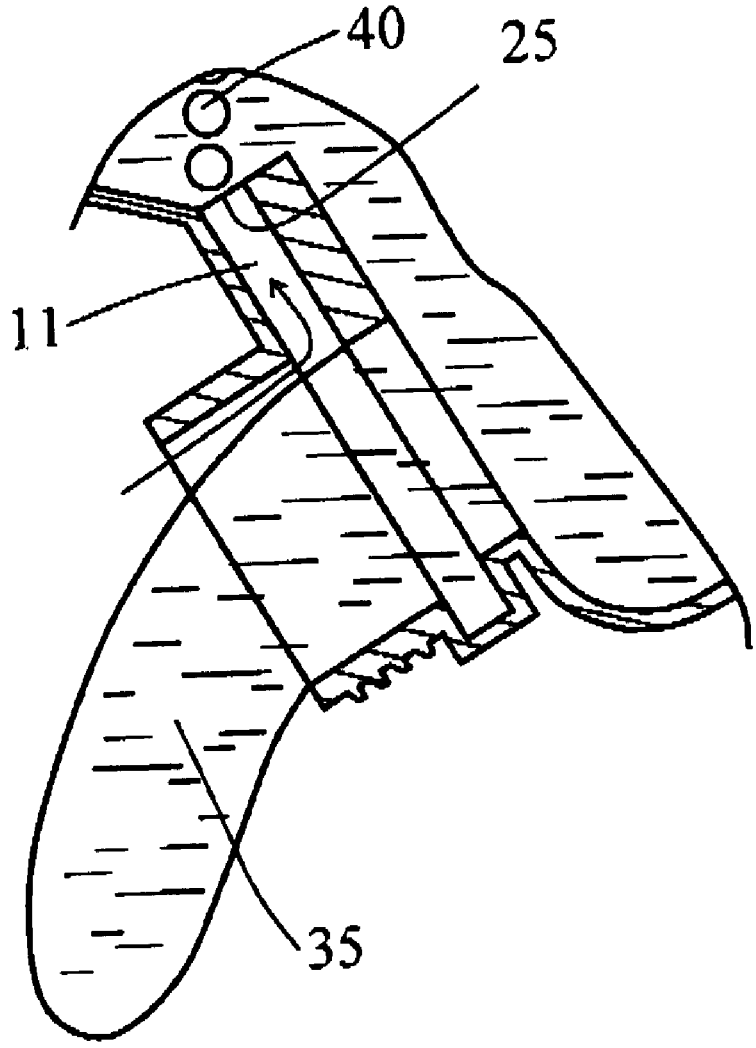
FIG. 6 is an enlarged sectional view of the mouth portion at a time of discharging an internal liquid according to the first embodiment.

FIG. 2A shows a front view, FIG. 2B shows a plane view and FIG. 2C shows a sectional view taken along a line A-A in FIG. 2A, of a container according to a first embodiment, and FIG. 3 shows an enlarged sectional view of a mouth portion. FIG. 4 is a sectional view taken along a line B-B in FIG. 3, and FIG. 5 is a sectional view taken along a line C-C in FIG. 3, as well. FIG. 6 is an enlarged sectional view of the mouth portion at a time of discharging an internal liquid 35 according to the first embodiment. In this first embodiment, a blow-molded portion 23 is formed under a screw portion.

Air 40, that is supplied into a container through an air channel 11, is released in the internal liquid 35 remained in the container. According to this mechanism, a discharging speed of the liquid can be kept approximately constant independently of the amount of the internal liquid.

Second Embodiment

Figure 7A:
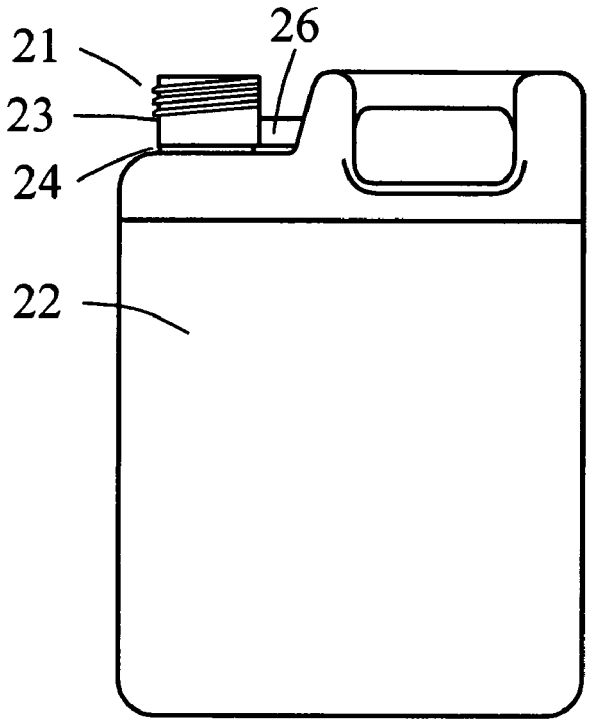
FIG. 7 includes a front view, a side view and a plane view of another container according to a second embodiment.
Figure 7B:
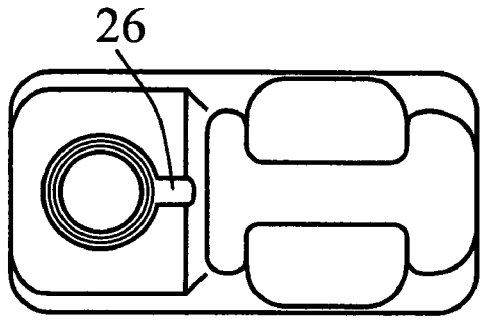
Figure 7C:
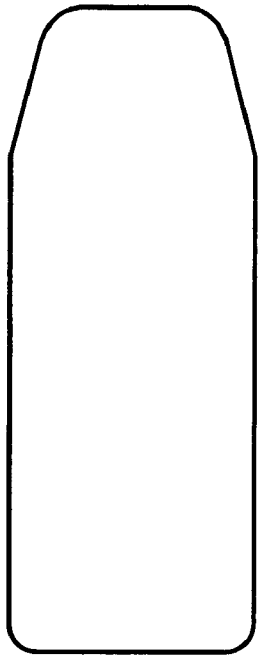
Figure 8:
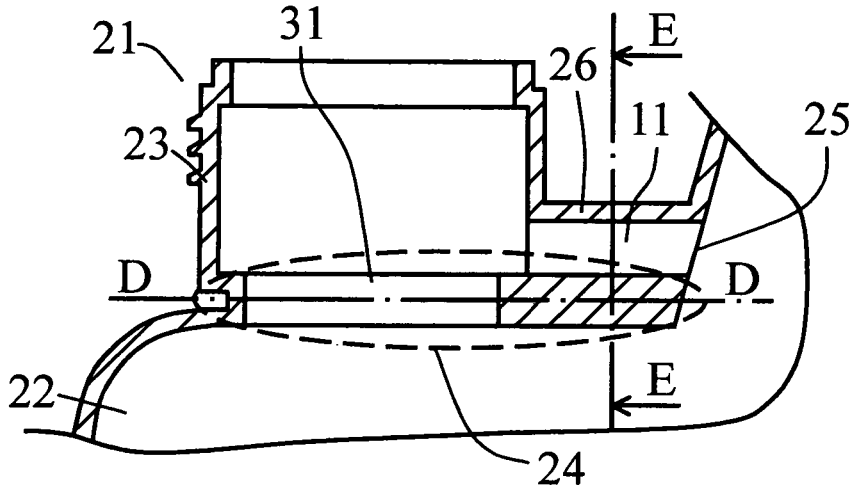
FIG. 8 is an enlarged sectional view of a mouth portion according to the second embodiment.
Figure 9:
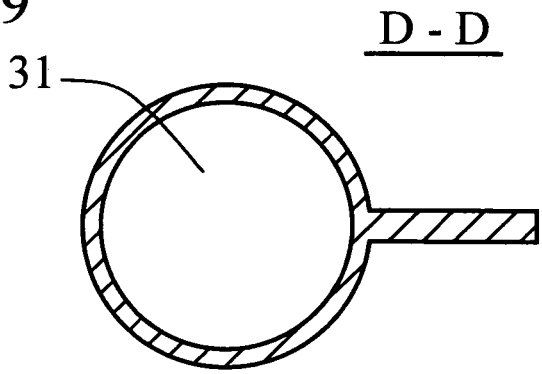
FIG. 9 is a sectional view taken along a line D-D in FIG. 8.
Figure 10:
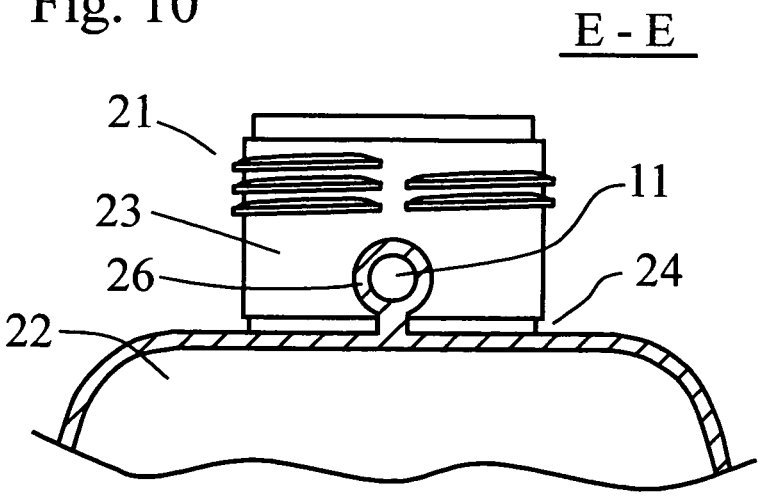
FIG. 10 is a sectional view taken along a line E-E in FIG. 8.

FIG. 7A shows a front view, FIG. 7B shows a plane view, FIG. 7C shows a side view of another container according to a second embodiment, and FIG. 8 is an enlarged sectional view of a mouth portion. In FIG. 7C, 26 is a rib holed through the air channel 11. FIG. 9 is a sectional view taken along a line D-D in FIG. 8, and FIG. 10 is a sectional view taken along a line E-E in FIG. 8, as well.

In this second embodiment, the blow-molded portion 23 includes the screw portion which is formed by a blow-molding process. In addition, the air channel 11 in a rib 26 communicates with both the blow-molded portion 23 and an internal space of a base portion of a handle that is provided at an upper portion of a body 22 of the container.

Third Embodiment

Figure 11A:
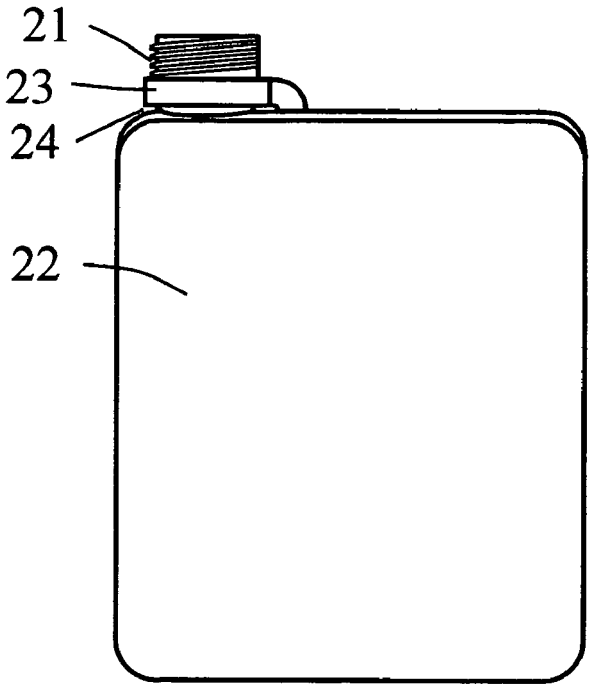
FIG. 11 includes a front view, a side view and a plane view of a still another container according to a third embodiment.
Figure 11B:
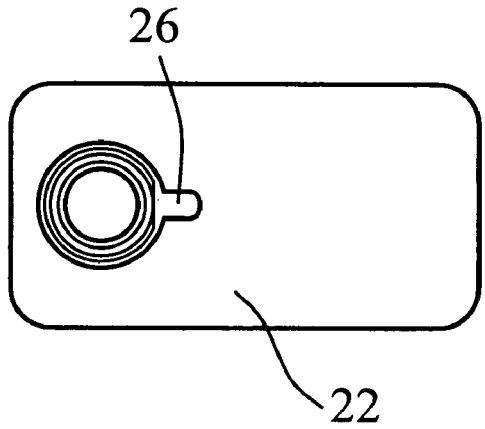
Figure 11C:
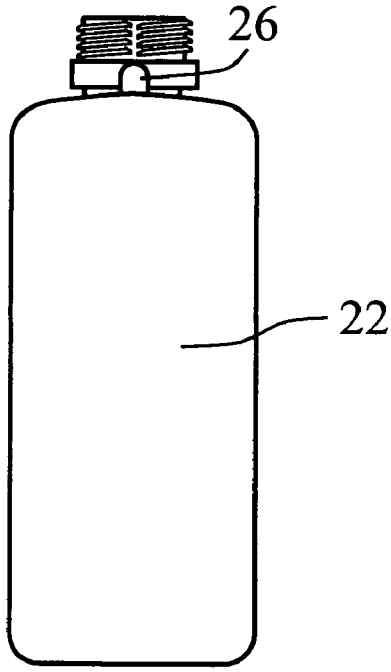

FIG. 11A shows a front view, FIG. 11B shows a plane view and FIG. 11C shows a side view of still another container according to a third embodiment. The air channel 11 in a rib 26 is short in length and compact in size, so that the air channel 11 can be applied not only to a flat square type container but also to a round bilge type container.

Fourth Embodiment

Figure 12A:
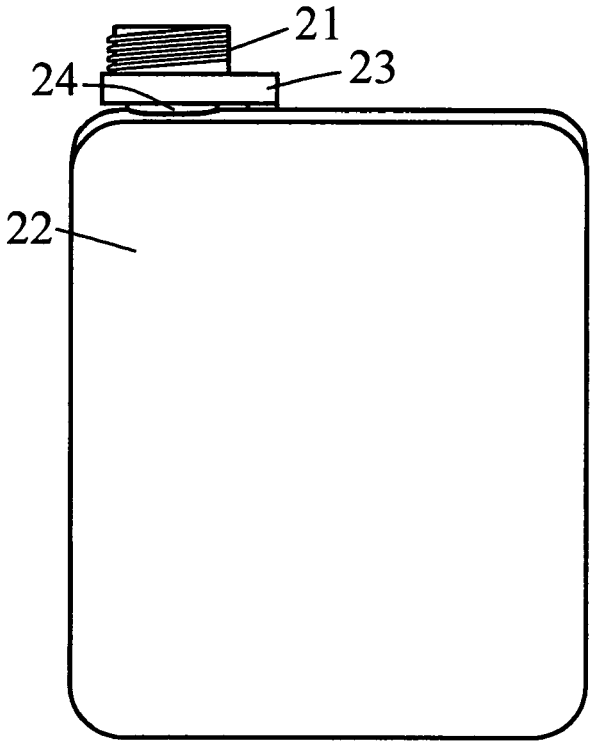
FIG. 12 includes a front view, a side view and a plane view of another container according to a fourth embodiment.
Figure 12B:
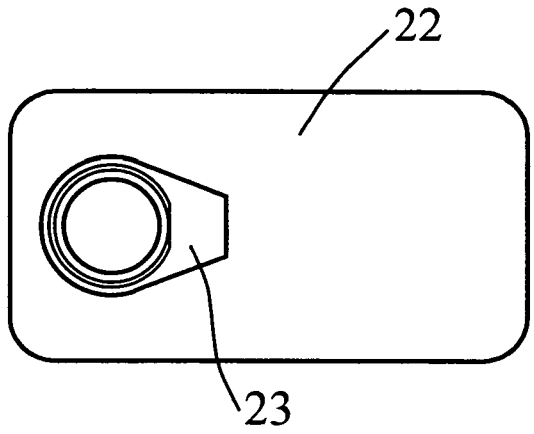
Figure 12C:
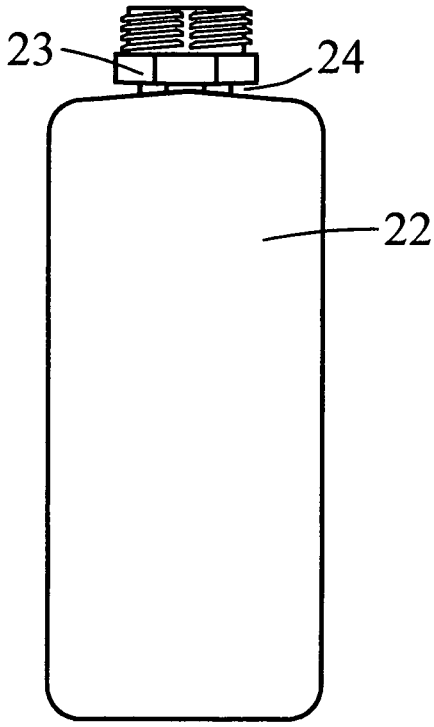
Figure 13:
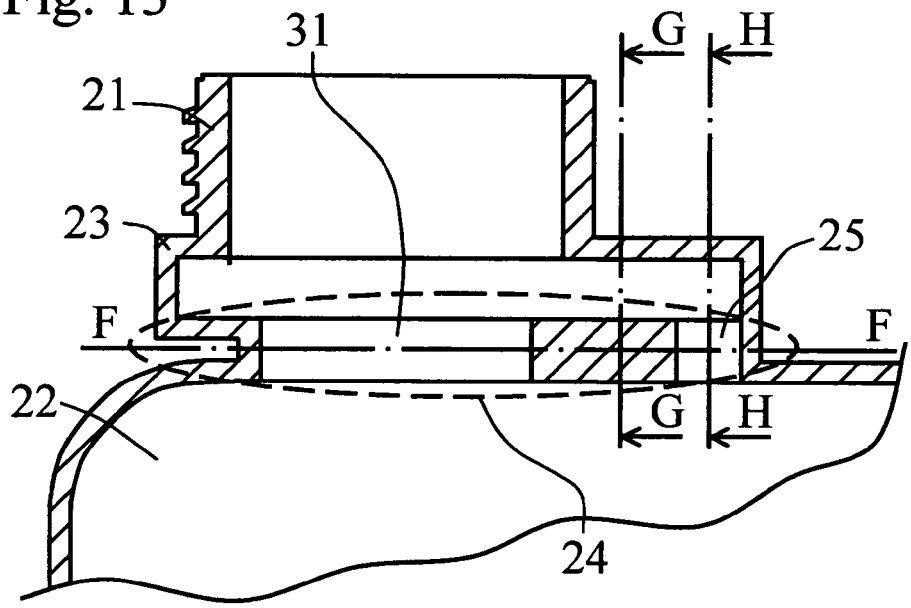
FIG. 13 is an enlarged sectional view of a mouth portion according to the fourth embodiment.
Figure 14:
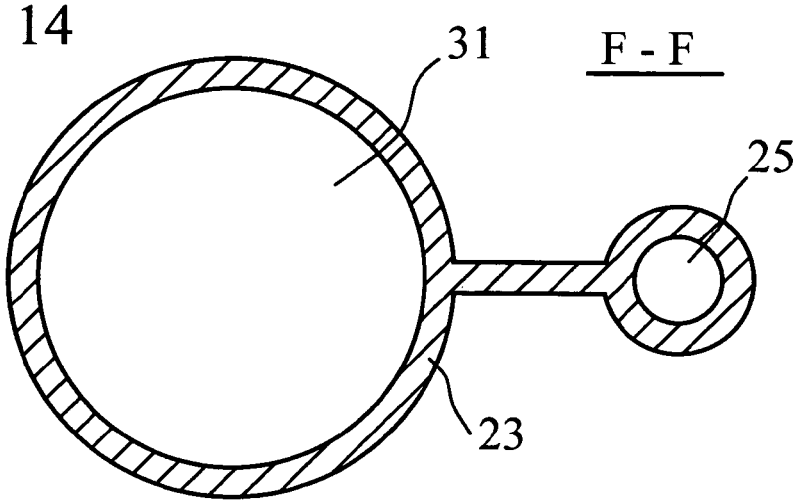
FIG. 14 is a sectional view taken along a line F-F in FIG. 13.
Figure 15:
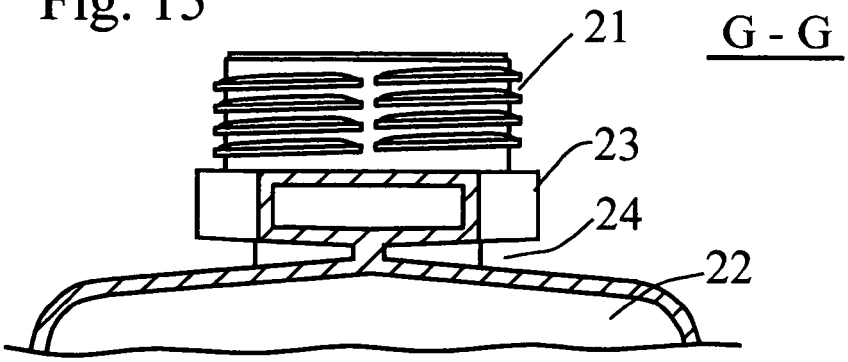
FIG. 15 is a sectional view taken along a line G-G in FIG. 13.
Figure 16:
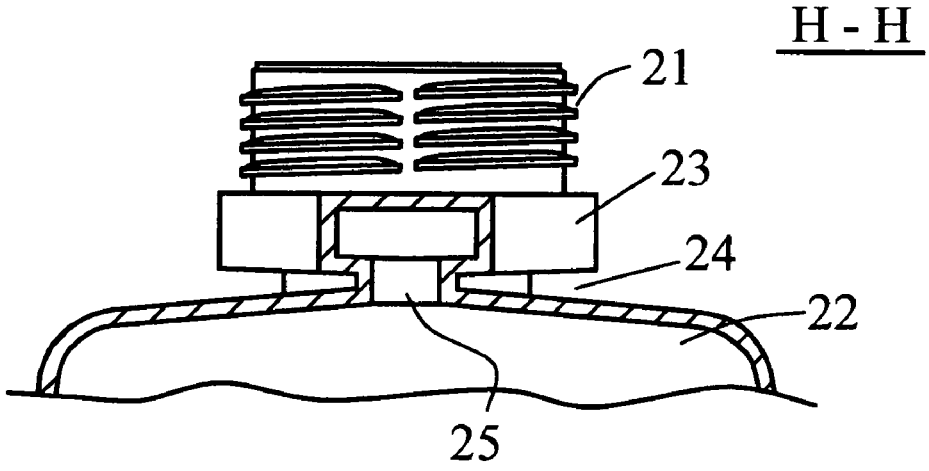
FIG. 16 is a sectional view taken along a line H-H in FIG. 13.
Figure 17:
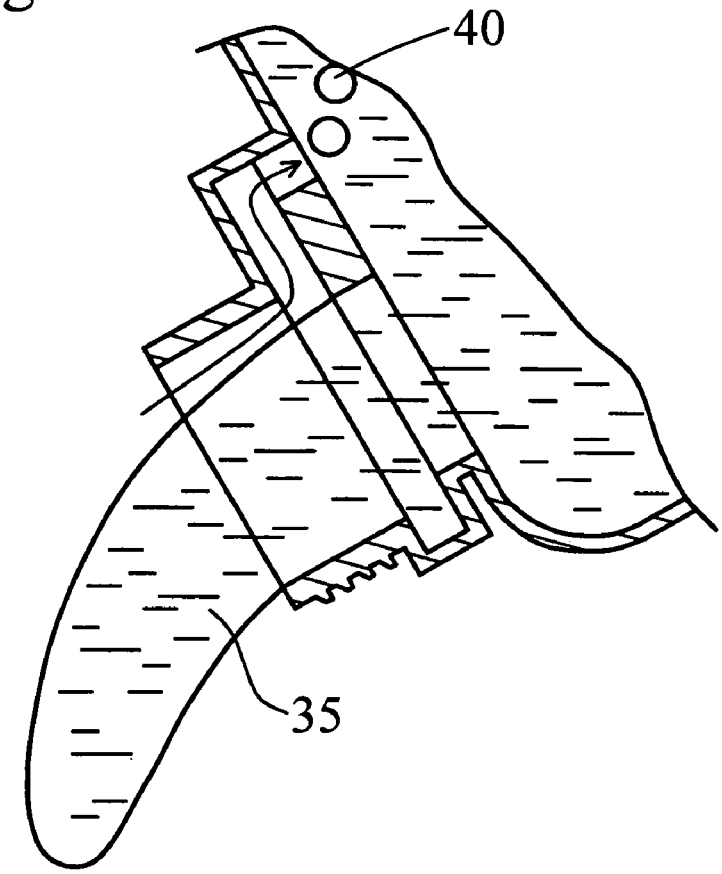
FIG. 17 is an enlarged sectional view of the mouth portion illustrating a state of discharging according to the fourth embodiment.

FIG. 12A shows a front view, FIG. 12B shows a plane view and FIG. 12C shows a side view of another container according to a fourth embodiment. FIG. 13 is an enlarged sectional view of its mouth portion and FIG. 14 is a sectional view taken along a line F-F in FIG. 13. FIG. 15 is a sectional view taken along a line G-G in FIG. 13, and FIG. 16 is a sectional view taken along a line H-H, as well. FIG. 17 is an enlarged sectional view of the mouth portion illustrating a state of discharge, according to the fourth embodiment. In the fourth embodiment, an air channel and an air port 25 was formed as an internal space of the blowmolded portion 23.

Fifth Embodiment

Figure 18A:
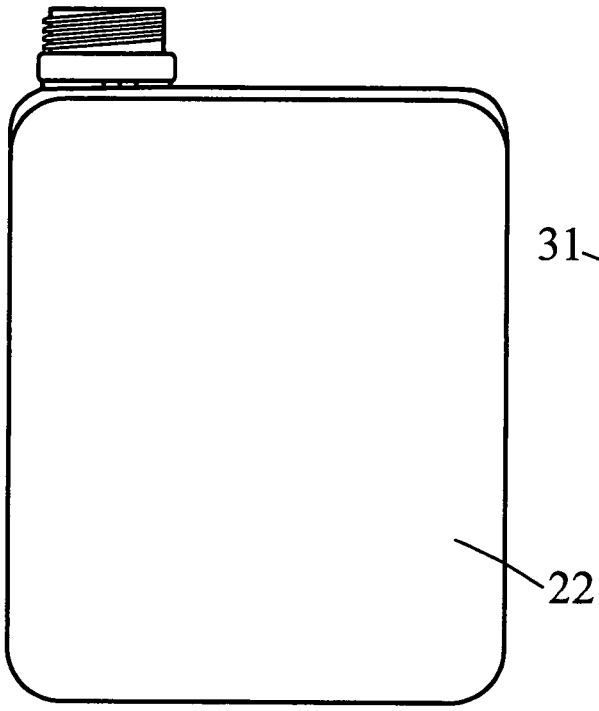
FIG. 18 includes a front view, a side view and a plane view of another container according to a fifth embodiment.
Figure 18B:
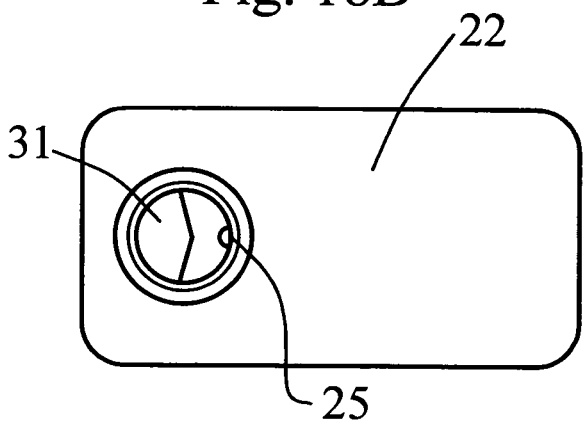
Figure 18C:
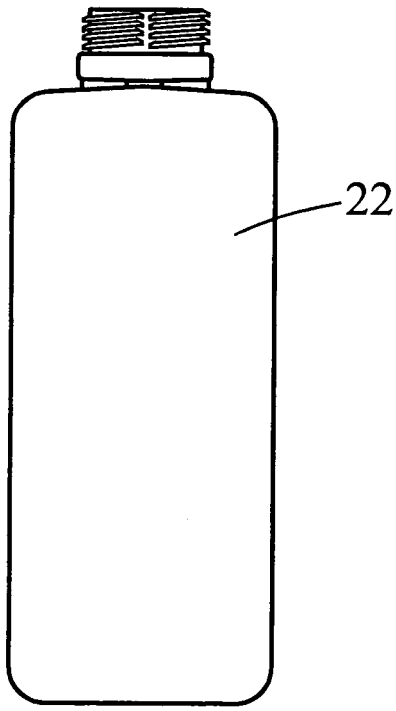
Figure 19:
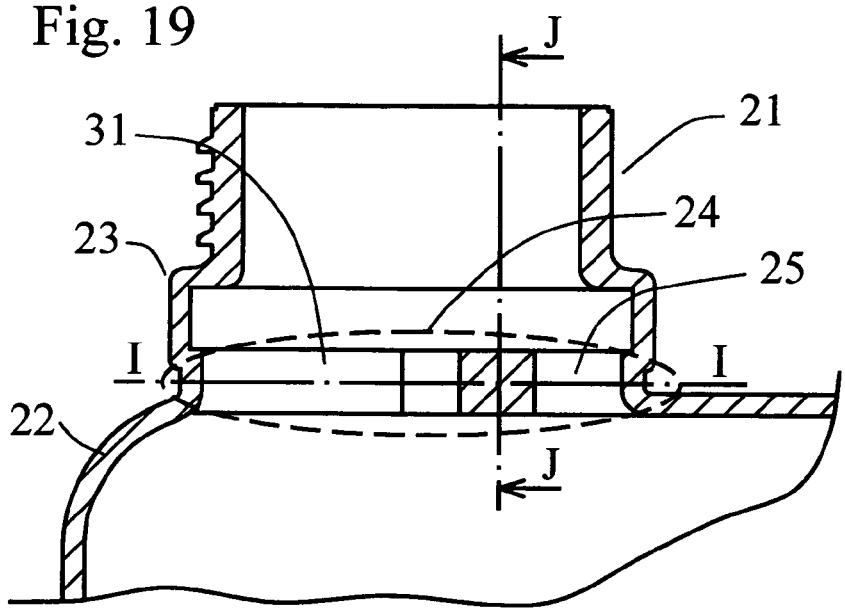
FIG. 19 is an enlarged sectional view of a mouth portion according to the fifth embodiment.
Figure 20:
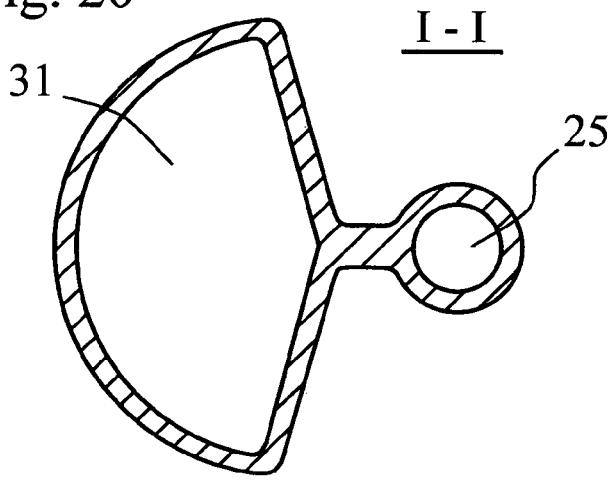
FIG. 20 is a sectional view taken along a line I-I in FIG. 19.
Figure 21:
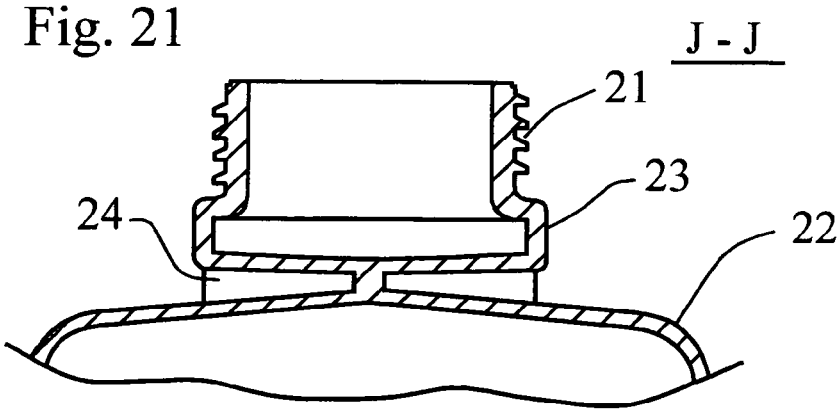
FIG. 21 is a sectional view taken along a line J-J in FIG. 19.
Figure 22:
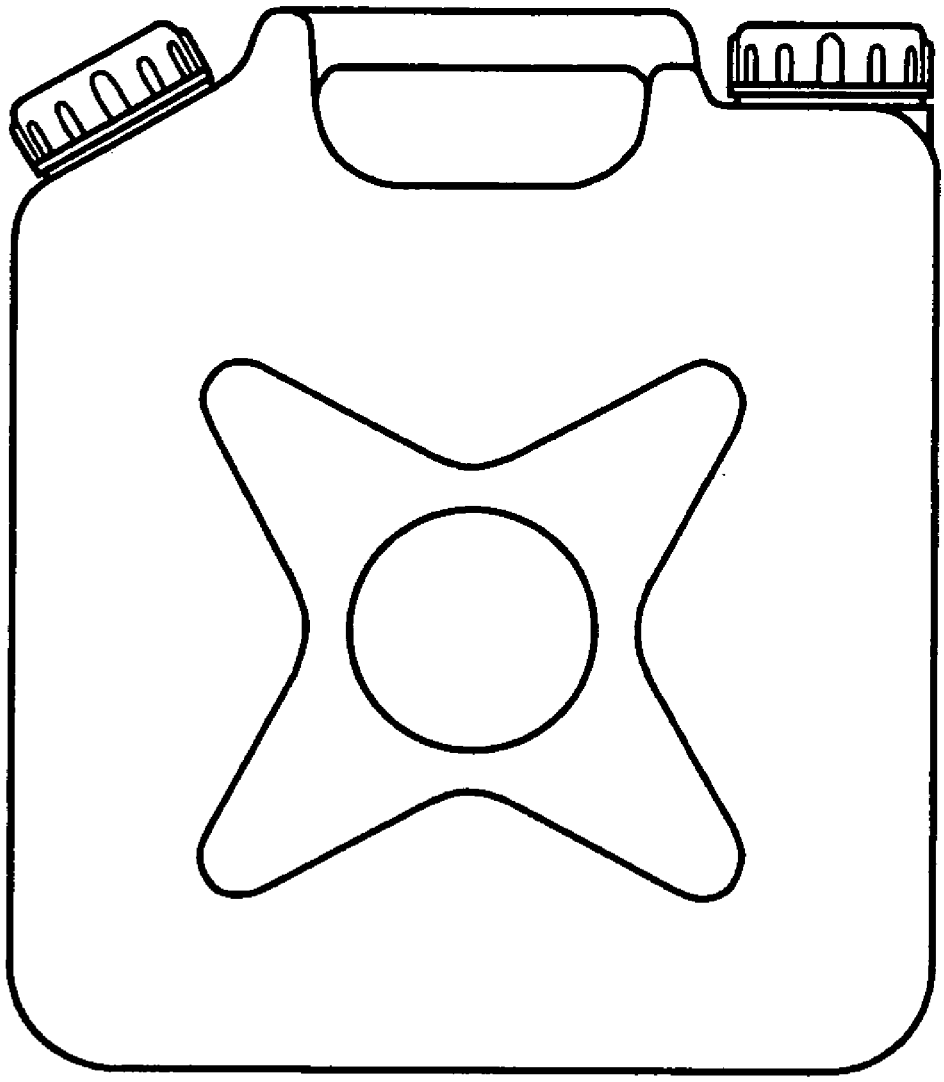
Fig. 22 Prior Art
FIG. 22 is a view illustrating a conventional two-mouth container.
Figure 23:
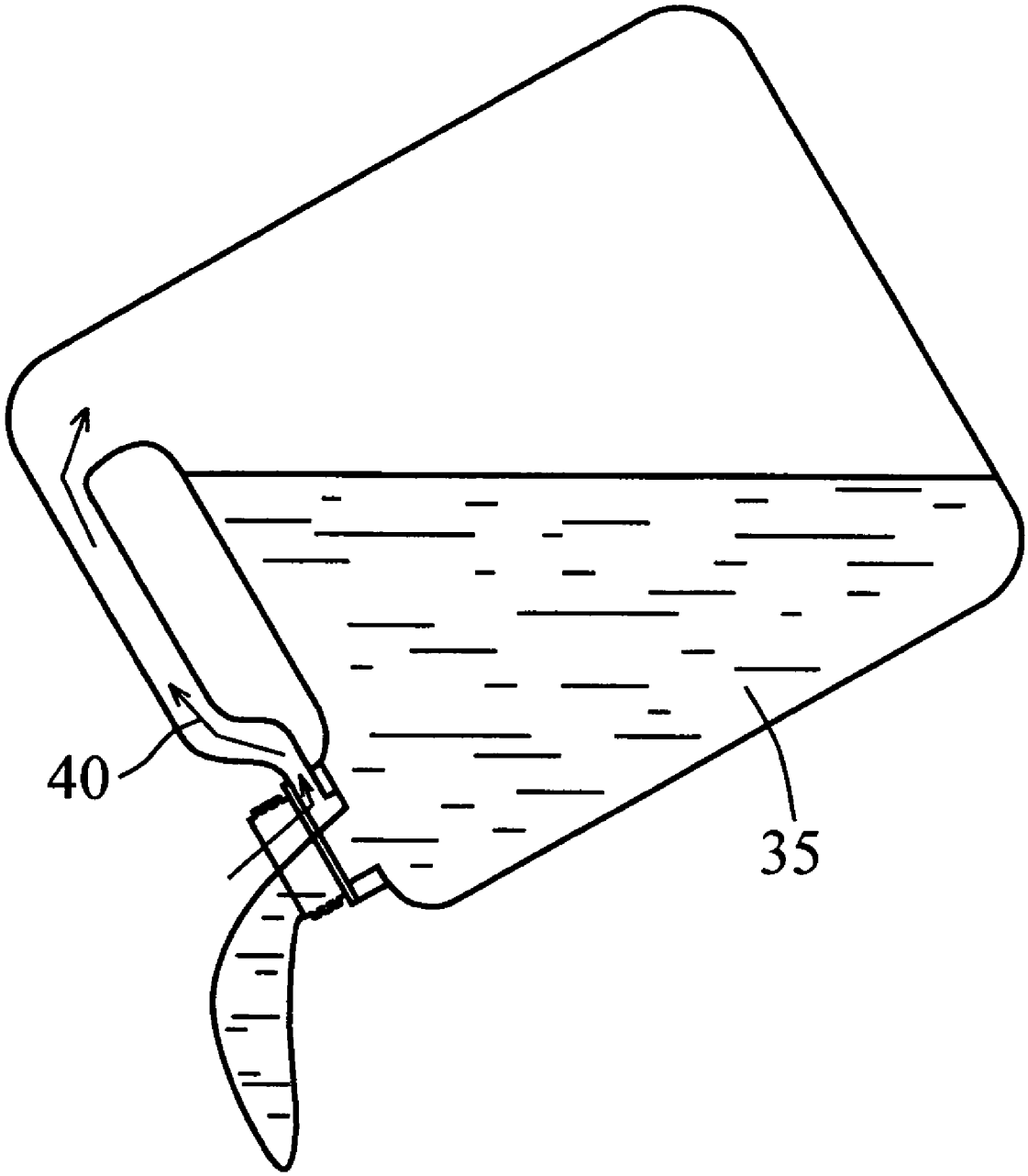
Fig. 23 Prior Art
FIG. 23 is a view illustrating a conventional container with an air intake mechanism.

FIG. 18A shows a front view, FIG. 18B shows a plane view and FIG. 18C shows side view of another container according to a fifth embodiment, and FIG. 19 is an enlarged sectional view of a mouth portion. FIG. 20 is a sectional view taken along a line I-I in FIG. 19, and FIG. 21 is a sectional view taken along a line J-J in FIG. 19, as well. In this embodiment, the air intake mechanism is much more compact in size, so that the air intake mechanism can be much easily applied not only to a square type container but also to a round bilge type container. However, a projection, which is peculiar to this type of air intake mechanism, is provided at an inner portion of the mouth, so that it is feared that there may cause a difficulty in inserting a liquid-filling nozzle etc. into the container.

The pulsation-free flow, when the internal liquid is discharged, can be realized with the one-mouth container. Discharging speed is kept approximately constant independently of the amount of the internal liquid remained in the container, so that there is no need to control the discharging speed by changing the angle of inclination of the container. The air intake mechanism is compact in size, so that the container can be designed more freely.

When manufacturing the container of the present invention, conventional molding processes can be used, so that there is no need to use a special molding machine or die. No sizable projection exists at the inner portion of the mouth, so that no difficulty arises in filling liquid or inserting a liquid-filling pump etc. into the container.

The invention claimed is:

1. A container having an air intake mechanism, comprising:

a container mouth portion;

a blow-molded body portion, having an opening larger than an opening of the container mouth portion and said opening located between the container mouth portion and the body portion;

a narrowed portion of a container body side portion of the blow-molded portion and a discharge port in the narrowed portion; and an air channel extending from and connecting a side wall of the blow-molded body portion positioned over the narrowed portion to the interior of the container body, the air channel having a length such that air supplied through an air port at an edge of the air channel will be released directly into liquid in the container when liquid is being discharged from the container, and the container is configured such that when the container is tilted for discharging liquid, the air port is below a level of liquid in the container and above the narrowed portion thereof.

2. The container with the air intake mechanism according to claim 1, wherein the narrowed portion, the discharge port and an air port are simultaneously formed by narrowing down a side portion of the container body side at the blow-molded portion.

3. The container with the air intake mechanism according to claim 1, wherein the discharge port has approximately a same axis as an axis of the container mouth portion and with approximately a same size and shape as a size and shape of the container mouth portion.

4. The container with the air intake mechanism according to claim 2, wherein the discharge port has approximately a same axis as an axis of the container mouth portion and with approximately a same size and shape as a size and shape of the container mouth portion.

* * * * *